US005439228A

United States Patent [19]

Pedersen

[11] Patent Number: 5,439,228

[45] Date of Patent: Aug. 8, 1995

[54] BOARD GAME APPARATUS AND METHOD OF PLAY

[76] Inventor: Geoffrey Pedersen, P.O. Box 109, Pocasset, Mass. 02559

[21] Appl. No.: 224,237

[22] Filed: Apr. 7, 1994

[51] Int. Cl.[6] ..... A63F 3/00

[52] U.S. Cl. ..... 273/236; 273/444; 273/286

[58] Field of Search ..... 273/236, 141 R, 444, 273/440, 286, 57.1, 449

[56] References Cited

U.S. PATENT DOCUMENTS 3,454,279 7/1969 Foley et al. ..... 273/444
4,039,186 8/1977 Andersen ..... 273/444

OTHER PUBLICATIONS

"Tictactics", Games Magazine, Oct. 1986, p. 46.
Spencer Gifts Catalog, Aug. 19, 1972, p. 23 "Giant Tic-Tac-Toe Game".
"Magic Carpets", Book of 1000 Family Games by Reader's Digest Association, Inc., 1971, p. 74.

*Primary Examiner*—Benjamin H. Layno
*Attorney, Agent, or Firm*—Fish & Richardson

[57] ABSTRACT

A game playing apparatus for use with a signaling device includes sheet material defining a confined playing area and an array of locations delineated on the playing area. The playing area is sized to permit the players to move around the playing area when a signal to start movement is given by the signaling device, and the array of locations is sized and spaced to permit a player to occupy each location of the array of locations when a signal to stop movement is given by the signaling device. The game is played like the well-known game of musical chairs, with the locations serving as the "chairs". Discs are provided to cover locations after successive rounds so that the number of available locations is less than the number of players competing in each round.

19 Claims, 2 Drawing Sheets

BOARD GAME APPARATUS AND METHOD OF PLAY

BACKGROUND OF THE INVENTION

This invention relates to a method of and apparatus for playing a game.

In the game of musical chairs, a number of chairs are arranged (generally in a circle) facing outwardly, with one fewer chair than the number of players. Music serves as a signal for the players to commence walking, skipping, or running around the chairs. The music is stopped to signal the players to stop movement and compete with each other to sit in the chairs. The player who is left without a seat is eliminated from the game. One chair is then removed, and the game continues in a number of rounds until there are only two players and one seat remaining. The player who is sitting in that chair at the end of the final round is the winner.

SUMMARY OF THE INVENTION

This invention provides a convenient, easy to use alternative to the standard way of playing the game of musical chairs. In one general aspect of the invention, the game playing apparatus includes sheet material defining a confined playing area and an array of locations delineated on the playing area. The playing area is sized to permit the players to move around the playing area when a signal to start movement is given by a signaling device, and the array of locations is sized and spaced to permit a player to occupy each location of the array of locations when a signal to stop movement is given by the signaling device.

The sheet material and array of locations replace the chairs normally needed to play the game of musical chairs. The sheet can be folded for easy storage and portability. The invention eliminates the need to assemble the chairs and enables the game to be played in environments where chairs may not be readily available.

Preferred embodiments include the following features.

The signalling device plays music (examples of the signalling device include a phonograph, a tape player, a CD player, etc.). Each round of play begins by starting the music, which signals the players to move around the sheet, and ends when the music is stopped to signal the players to occupy the locations. A set of discs is included to designate one or more locations that are unavailable to be occupied in each round. The discs are used to cover selected locations so that during each round there is one fewer location that can be occupied than the number of players.

The array of locations is a rectangular matrix of nine locations. Each of the nine locations is a different color. Eight of the nine locations are peripheral locations that surround the ninth, center location. The center location is reserved for use in the final round, when all the peripheral locations are covered with discs and only two players remain. Prior to the final round, the center location is covered by a disc; the disc is removed for the final round. The player who occupies the center location at the end of the final round wins the game.

Other features and advantages of the invention will become apparent from the following detailed description, and from the claims.

DESCRIPTION OF A PREFERRED EMBODIMENT

Figure 1:
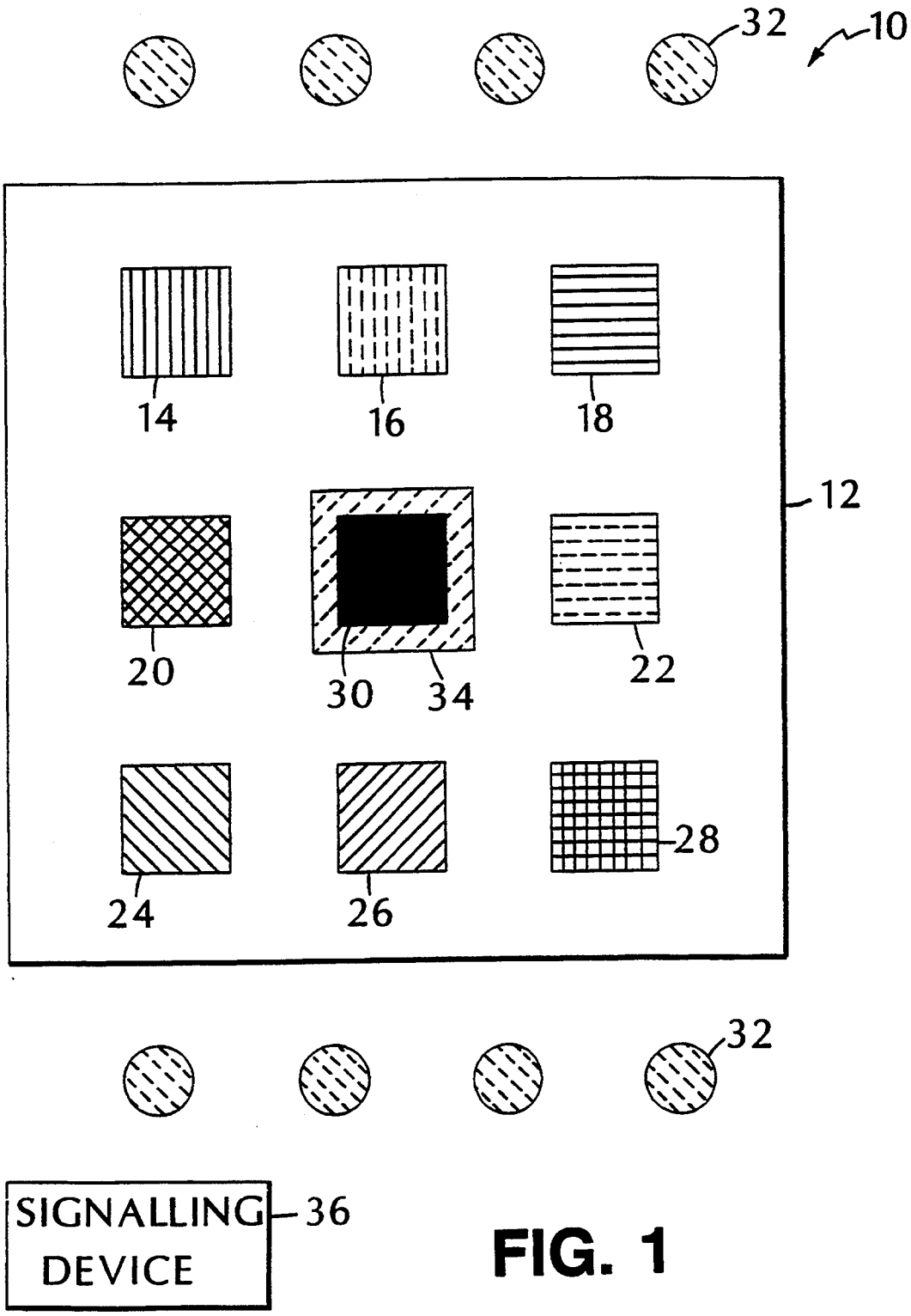
FIG. 1 shows the game playing apparatus.

Referring to FIG. 1, game playing apparatus 10 includes sheet material 12 made from white vinyl and having an array of nine locations 14–30 arranged thereon in a rectangular matrix. Sheet material 12 and locations 14–30 are of such size and spacing as to permit players to move around sheet material 12 and occupy locations 14–30 during play. For example, sheet 12 is five feet wide by six feet long, each location 14–30 is one square foot, and locations 14–30 are equally spaced around sheet material 12. Eight of the nine locations 14–30 are designated as peripheral locations 14–28, and the ninth location as center location 30. Center location 30 is reserved for use in the final round of play when only two players remain, as explained below.

As shown in FIG. 1 by the different cross hatching on locations 14–30, each of the nine locations 14–30 is a different color. Location 14 is red, location 16 is purple, location 18 is blue, location 20 is orange, location 22 is maroon, location 24 is green, location 26 is light blue, and location 28 is yellow. Center location 30 is black and is highlighted with a pink border 34.

As in the game of musical chairs, in which the number of chairs is one fewer than the number of players in each round, game 10 is played in a series of rounds in which one less peripheral location 14–28 is available to be occupied than the number of players who compete in each round. A set of nine discs 32 (one for each location 14–30) are provided for designating locations 14–30 that are unavailable during successive rounds of play. Discs 32 are circular (e.g., 8" in diameter) and are made from white plastic.

Game 10 is played with two to nine players. At the start of play, center location 30 is covered with a disc 32, and as many discs 32 as necessary are placed on opposing peripheral locations 14–28 so that the number of available peripheral locations 14–28 is one fewer than the number of players. For example, if there are nine players, none of peripheral locations 14–28 are covered with discs 32 at the start of play. On the other hand, if there are eight players, one peripheral location (such as location 18) is covered with a disc 32. Center location 30 remains covered until the final round.

Game 10 is played with the aid of any suitable signalling device 36, for example, a phonograph, tape player, CD player or the like for playing music. Play starts with the players standing around the periphery of sheet material 12. Uncovered locations 14–28 represent the empty chairs of the game of musical chairs. When the signal to start movement is given by signalling device 36, e.g., by starting music, the players move, e.g., walk, skip, run, etc., around sheet material 12. When the music is stopped (signalling the end of the round), the players compete to occupy peripheral locations 14–28 (such as by standing or sitting on them). The player who is left not occupying a peripheral location 14–28 is eliminated from the game. A player can also be eliminated from the game if the player touches sheet material 12 before the music is stopped. Before the next round begins, an additional peripheral location 14–28 is covered by a disc 32 so that the number of available peripheral locations 14–28 is maintained at one fewer than the number of remaining players.

Figure 2:
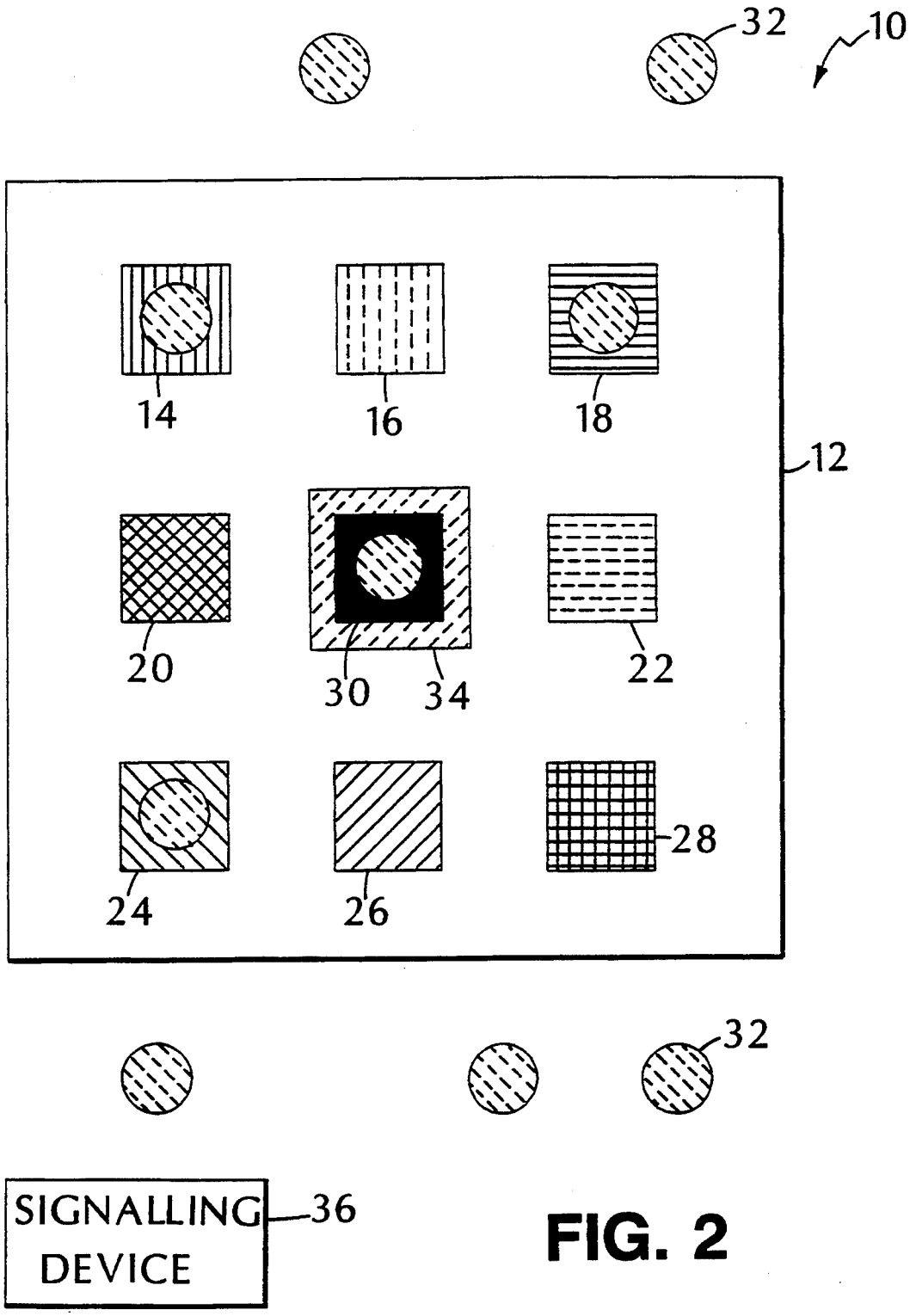
FIG. 2 shows the game playing apparatus of FIG. 1 after three rounds of play.

FIG. 2 shows how sheet material 12 might look during the fourth round of play. At this point, the first through third rounds have been played, and three players have been eliminated. At the end of round one, one location, e.g., 18, was covered with a disc 32. At the end of round two, an opposing peripheral location, e.g., 24, was covered with a disc 32. A third disc 32 was placed on, e.g. location 14. As a result, five peripheral locations 16, 20, 22, 26 and 28 remain available. The order in which peripheral locations 14–28 are covered is such that the uncovered locations are symmetric around the periphery of sheet material 12.

The process of covering peripheral locations 14–28 after successive rounds is repeated in the manner discussed above until only two players remain. At this point, all peripheral locations 14–28 are covered. Disc 32 is then removed from center location 30, exposing center location 30 for play.

During the final round, the two remaining players "square off" around center location 30. When the music is started by signalling device 36, the two players move around (but not on) sheet material 12. When the music is stopped, both players attempt to occupy center location 30; the player who succeeds wins the game.

Other embodiments are within the scope of the following claims.

For example, sheet material 12 may be of any suitable size, color, or geometry (e.g., round, triangular, rectangular, etc.) Locations 14–30 may all be the same color or may have different colors than those given above. Locations 14–30 may all be of different sizes, either uniform or different from each other. Locations 14–30 may be different geometries, e.g., all circles or some squares, some circles, some triangles, etc.

The number and arrangement of locations 14–30 may vary. For example, a rectangular array of four by three locations may be provided, allowing up to twelve players to play.

Discs 32 may be different sizes and geometries. Discs 32 could all be the same color, different colors than given above, or any desired pattern.

Game 10 need not be played strictly in accordance with the protocol discussed above. For example, a time limit could be placed on the time allowed to arrive at locations 14–30. In such an embodiment, more than one player may be eliminated in a round and more than one peripheral location 14–28 covered at the end of a round.

The location reserved for the final round could be one other than center location 30. Center location 30 may be designated as out of bounds without the use of a disc 32.

What is claimed is:

1. Game playing apparatus comprising:

sheet material defining a confined playing area and an array of locations delineated on said playing area, said playing area being of such size as to permit movement by persons around said playing area in response to a signal to start movement, said array of locations being of such size and spacing as to permit a person to occupy each said location of said array of locations in response to a signal to stop movement, and a sound-producing device adapted to begin producing sound to provide said signal to start movement, and to subsequently stop producing sound to provide said signal to stop movement.

2. The game playing apparatus of claim 1 wherein a combination of said signal to start followed by said signal to stop defines a round, said game playing apparatus further comprising a set of discs for designating locations not to be occupied, each said disc for covering one of said locations during a said round of play so that during each said round there is one fewer location that can be occupied than the number of people playing.

3. The game playing apparatus of claim 2 wherein said array is a rectangular matrix.

4. The game playing apparatus of claim 3 wherein said rectangular matrix comprises nine locations, eight of said nine locations being peripheral locations and a ninth said location being a center location, said center location being reserved for use in the final round when all peripheral locations are covered with said discs and only two players remain.

5. The game playing apparatus of claim 4 wherein each of said nine locations is a different color.

6. The game playing apparatus of claim 1 wherein said sound producing device is a device for playing music.

7. A method for playing a game, comprising providing sheet material defining a confined playing area and an array of locations delineated on said playing area, signalling players to start movement around said playing area, signalling the players to stop movement and attempt to occupy said array of locations, and limiting a number of said locations that are available to be occupied by said players so that the number of locations available is less than the number of players.

8. The method of claim 7 wherein said step of limiting includes placing discs on one or more of said locations to designate them as unavailable to be occupied.

9. The method of claim 8 further comprising defining a round of play by a combination of signalling the players to start movement followed by signalling the players stop movement, and allowing each round to be played by a number of people that exceeds the number of said locations that do not have one of said discs disposed thereon so that during each said round there is one fewer location that can be occupied than the number of people playing.

10. The method of claim 9 further comprising defining said array as a rectangular matrix.

11. The method of claim 10 further comprising providing said rectangular matrix with nine locations, eight of said nine locations being peripheral locations and a ninth said location being a center location, said center location being reserved for use in the final round when all peripheral locations are covered with said discs and only two players remain.

12. The method of claim 11 further comprising providing each of said nine locations with a different color.

13. The method of claim 7 wherein said step of signalling the players to start movement includes playing music, and said step of signalling the players to stop movement includes stopping the music.

14. Game playing apparatus comprising:

sheet material defining a confined playing area and an array of locations delineated on said playing area, said playing area being of such size as to permit movement by persons around said playing area in response to a signal to start movement, said array of locations being of such size and spacing as to permit a person to occupy each said location of said array of locations in response to a signal to stop movement, and a set of substantially identically configured disks visually undistinguishable from each other each of which is configured to be disposed on one of said locations to designate that said location is unavailable to be occupied, said set including at least as many discs as are needed to cover all but one of said locations.

15. The game playing apparatus of claim 14 wherein the number of discs in said equals the number of said array of locations.

16. The game playing apparatus of claim 15 wherein said array is a rectangular matrix.

17. The game playing apparatus of claim 16 wherein said rectangular matrix comprises nine locations, eight of said nine locations being peripheral locations and a ninth said location being a center location, said center location being reserved for use in a final round of said game when all peripheral locations are covered with said discs and only two players remain.

18. The game playing apparatus of claim 17 wherein each of said nine locations is a different color.

19. Game playing apparatus comprising:

sheet material defining a confined playing area and an array of locations delineated on said playing area, said playing area being of such size as to permit movement by persons around said playing area in response to a signal to start movement, said array of locations being of such size and spacing as to permit a person to occupy each said location of said array of locations in response to a signal to stop movement, a set of substantially identical disks each of which is configured to be disposed on one of said locations to designate that said location is unavailable to be occupied, said set including at least as many discs as are needed to cover all but one of said locations, and a music playing device adapted to begin playing music to provide said signal to start movement, and to subsequently stop playing music to provide said signal to stop movement.

* * * * *